US009715873B2

(12) United States Patent
Graham

(10) Patent No.: US 9,715,873 B2
(45) Date of Patent: Jul. 25, 2017

(54) METHOD FOR ADDING REALISM TO SYNTHETIC SPEECH

(71) Applicant: ClearOne Inc., Salt Lake City, UT (US)

(72) Inventor: Derek Graham, South Jordan, UT (US)

(73) Assignee: ClearOne, Inc., Salt Lake City, UT (US)

( * ) Notice: Subject to any disclaimer, the term of this patent is extended or adjusted under 35 U.S.C. 154(b) by 0 days.

(21) Appl. No.: 14/833,512

(22) Filed: Aug. 24, 2015

(65) Prior Publication Data

US 2016/0140952 A1 May 19, 2016

Related U.S. Application Data

(60) Provisional application No. 62/042,043, filed on Aug. 26, 2014.

(51) Int. Cl.
*G10L 13/08* (2013.01)
*G10L 13/033* (2013.01)
(Continued)

(52) U.S. Cl.
CPC ..... *G10L 13/033* (2013.01); *G10L 13/08* (2013.01); *G10L 13/047* (2013.01); *G10L 13/10* (2013.01)

(58) Field of Classification Search
CPC ..... G10L 13/08; G10L 13/02; G10L 13/033; G10L 13/04; G10L 19/00;
(Continued)

(56) References Cited

U.S. PATENT DOCUMENTS 6,012,028 A * 1/2000 Kubota ..... G10L 13/02 434/130
6,081,780 A * 6/2000 Lumelsky ..... G10L 13/08 704/260
(Continued)

FOREIGN PATENT DOCUMENTS

CN 102402981 A 4/2012
CN 103117057 A 5/2013
(Continued)

OTHER PUBLICATIONS

"The MBROLA Project", The MBROLA TTS engine and database builder, Available at http://tcts.fpms.ac.be/synthesis/mbrola.html.
(Continued)

*Primary Examiner* — Vijay B Chawan
(74) *Attorney, Agent, or Firm* — Matthew J. Booth & Associates PLLC; Matthew J. Booth

(57) ABSTRACT

The present disclosure provides a method for adding realism to synthetic speech. The method includes receiving text (218) that is to be converted into synthetic speech from a mobile device (108). The text (218) may include embedded emoticons indicating a first prosody information and a predefined sound stored in a stored data repository (208). The method also includes identifying a user associated with the text (218) based on a comparison between metadata associated with the text (218) and user profiles stored in the stored data repository (208); retrieving a speech font from a speech data corpus associated with the user stored in the stored data repository (208). The speech font includes a second prosody information and a predefined accent of the user. The method further includes converting the text (218) into synthetic speech based on the retrieved speech font, which is being modulated based on the emoticon.

16 Claims, 12 Drawing Sheets

(51) Int. Cl.
*G10L 13/10* (2013.01)
*G10L 13/047* (2013.01)

(58) Field of Classification Search
CPC ..... G10L 2013/083; G10L 2015/088; G06F 17/30761; G06F 17/3089; H04M 2201/60; H04M 3/487; H04M 7/12
USPC ..... 704/260, 275, 273, 270, 277, 231, 232, 704/233, 234, 235, 251, 258, 261, 266, 704/268; 725/115
See application file for complete search history.

(56) References Cited

U.S. PATENT DOCUMENTS

| | | | | |
|---|---|---|---|---|
| 6,119,086 | A | 9/2000 | Ittycheriah et al. | |
| 6,161,091 | A | 12/2000 | Akamine et al. | |
| 6,510,413 | B1 | 1/2003 | Walker | |
| 6,792,407 | B2 | 9/2004 | Kibre et al. | |
| 7,277,856 | B2 | 10/2007 | Lee et al. | |
| 7,953,600 | B2 | 5/2011 | Hertz et al. | |
| 8,046,225 | B2 | 10/2011 | Masuko et al. | |
| 8,285,549 | B2 | 10/2012 | Teegan et al. | |
| 8,412,528 | B2 | 4/2013 | Fischer et al. | |
| 8,516,533 | B2 * | 8/2013 | Davis | H04N 21/482 725/115 |
| 8,655,659 | B2 * | 2/2014 | Wang | G10L 13/033 704/231 |
| 2006/0116881 | A1 | 6/2006 | Umezawa | |
| 2009/0187577 | A1 * | 7/2009 | Reznik | G06F 17/30761 707/999.01 |
| 2011/0010179 | A1 | 1/2011 | Naik | |
| 2012/0072224 | A1 | 3/2012 | Khitrov | |
| 2012/0265533 | A1 | 10/2012 | Honeycutt | |
| 2013/0289998 | A1 * | 10/2013 | Eller | G10L 13/08 704/260 |
| 2014/0067397 | A1 * | 3/2014 | Radebaugh | G10L 13/08 704/260 |

FOREIGN PATENT DOCUMENTS

| | | | |
|---|---|---|---|
| JP | 2013-117638 | A | 6/2013 |
| WO | 02080140 | A1 | 10/2002 |
| WO | 2013164870 | A1 | 11/2013 |

OTHER PUBLICATIONS

Holmes et al., "Speech Synthesis and Recognition", Taylor & Francis, Inc., Jan. 2002.
Latorre et al., "New Approach to Polyglot Synthesis: How to Speak Any Language with Anyone's Voice", Department of Computer Science, Tokyo Institute of Technology, Tokyo, Japan, Apr. 9-11, 2006, 6 pages.
Malfrere et al., "Fully Automatic Prosody Generator for Text-to-Speech Synthesis", Proc. of Int. Conf. on Speech and Language Processing, 1998, pp. 1395-1398.
"PC-KIMMO: A Two-level Processor for Morphological Analysis", Available at <http://www.sil.org/pckimmo/>, Retrieved on Jul. 9, 2015, 4 pages.
Sjolander, Kare, "The Snack Sound Toolkit", TMH/Software , Available at <http://www.speech.kth.se/snack/>, 1997-2004, 2 pages.
Soman et al., "Corpus Driven Malayalam Text-to-Speech Synthesis for Interactive Voice Response System", International Journal of Computer Applications (0975-8887), vol. 29, No. 4, Sep. 2011, pp. 41-46.
"TTSBOX: A Matlab-based tutorial toolbox for teaching Text-to-Spech Synthesis to Undergraduate and Graduate Students", Available at http://tcts.fpms.ac.be/projects/ttsbox/, retrieved on Jul. 9, 2015, 2 pages.
Jurafsky et. al., "Speech and Language Processing" Prentice Hall, Apr. 2008.
Dutoit, Thierry, "Introduction to Text-to-Speech Synthesis", vol. 1-3, Springer-Verlag New York, LLC.
Microsoft Research, "Microsoft Audio Watermarking Tool", Available at <http://research.microsoft.com/enus/downloads/885bb5c4-ae6d-418b-97f9-adc9da8d48bd/default.aspx>, retrieved on Jul. 10, 2015, 1 page.

* cited by examiner

METHOD FOR ADDING REALISM TO SYNTHETIC SPEECH

CROSS REFERENCES TO RELATED APPLICATIONS

This application claims priority and the benefits of the earlier filed Provisional U.S. application No. 62/042,024, filed 26 Aug. 2014, which is incorporated by reference for all purposes into this specification.

TECHNICAL FIELD

The present disclosure generally relates to speech synthesis, and more particularly to systems and methods for realistic speech synthesis.

BACKGROUND ART

Rapid increase in the number of mobile phone users has encouraged implementation of various new features on mobile phones to enhance user experience. One such desirable feature is speech synthesis that converts text to speech and allows a user to avoid manual reading of text on the small screen of a mobile phone. Speech synthesis enables a mobile phone user to listen to text messages such as emails and SMS (short messaging service) messages while being engaged in other tasks (e.g., preparing a meal, navigating through snail mail letters, driving an automobile, etc.).

The synthesized speech typically resembles an artificial voice that mimics various voice characteristics such as gender, age, dialect, accent, etc. or any other voice-related data or metadata of an intended speaker, who is not related to or associated with the text. The artificial voice provides a monotonous and unrealistic listening experience to the user. Further, a concatenative speech synthesis system relies on audio recordings collected from a specific talker. Generally, time is reserved in a sound recording booth and the target talker is asked to read some text into a microphone. Therefore, collection of speech data from the recorded speech becomes dependent on speaker's availability, thereby complicating the collection of speech data across multiple speakers.

To solve these problems, a speech synthesis solution that simplifies collection of speech data while improving the realism of the synthesized speech for a better user experience is desirable.

SUMMARY OF INVENTION

This disclosure describes systems and methods for realistic speech synthesis. In one aspect, the present disclosure provides a system using a realistic speech synthesis (RSS) device with one or more mobile devices that are in communication with one or more stored data repositories, which adds realism to synthetic speech. The system comprises a first mobile device, a second mobile device, and the RSS device. The first mobile device, with a processor and a memory, associated with the first user, sends text to a second mobile device; the second mobile device, with a processor and a memory, associated with the second user, in communication with the first mobile device and the stored data repository, wherein the second mobile device receives the text from the first mobile device, wherein the text may include at least one embedded emoticon indicating a first prosody information stored in the stored data repository; and the realistic speech synthesis device in communication with the second mobile device, configured to convert the text to synthetic speech, wherein the realistic speech synthesis device is configured to: receive the text from the second mobile device; identify the first user based on a comparison between metadata associated with the text and user profiles stored in the stored data repository; retrieve a speech font from a speech data corpus associated with the first user stored in the stored data repository, wherein the speech font includes a second prosody information and a predefined accent of the first user; convert the text into synthetic speech based on the retrieved speech font, wherein the speech font is modulated based on the at least one emoticon; and send the synthetic speech to the second mobile device via said network. Additionally, the present disclosure provides that the stored data repository is on a user device (e.g., the first mobile device and the second mobile device) and/or a server via the network.

Other and further aspects and features of the disclosure will be evident from reading the following detailed description of the embodiments, which are intended to illustrate, and not limit, the present disclosure.

BRIEF DESCRIPTION OF DRAWINGS

To further aid in understanding the disclosure, the attached drawings help illustrate specific features of the disclosure and the following is a brief description of the attached drawings.

DISCLOSURE OF EMBODIMENTS

This disclosure describes systems and methods for performing realistic speech synthesis. This disclosure describes numerous specific details in order to provide a thorough understanding of the present invention. One ordinarily skilled in the art will appreciate that one may practice the present invention without these specific details. Additionally, this disclosure does not describe some well-known items in detail in order not to obscure the present invention.

Figure 1A:
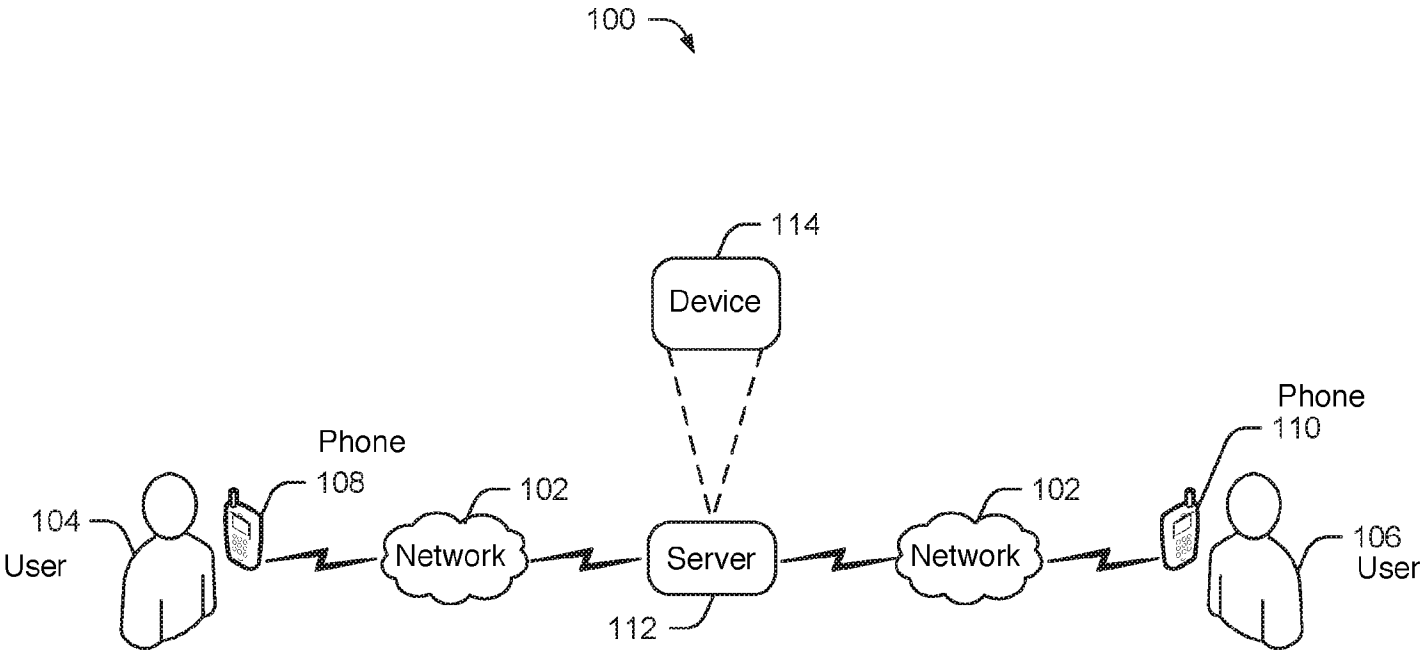
FIGS. 1A-1D are schematics that illustrate exemplary network environments for implementing a realistic speech synthesis (RSS) device, where communication devices communicate with each other via a server.

FIGS. 1A-1D are schematics that illustrate exemplary network environments for implementing a realistic speech synthesis (RSS) device 114, where communication devices communicate with each other via a server 112, according to an embodiment of the present disclosure. Embodiments are disclosed in the context of voice and data communications over a network 102. FIG. 1A is a schematic that illustrates an exemplary network environment 100 for implementing one embodiment of the realistic speech synthesis (RSS) device 114. In the illustrated network environment 100, a first user 104 may communicate with a second user 106 using a first mobile phone 108 and a second mobile phone 110 respectively via the server 112 over the network 102. In some embodiments, the first mobile phone 108 and the second mobile phone 110 may be implemented as any of a variety of calling devices (e.g., a telephone, an internet phone, etc.) or computing devices (e.g., a server, a desktop PC, a notebook, a workstation, a personal digital assistant (PDA), a mainframe computer, a mobile computing device, etc.) having voice and data communication capabilities or any other device having similar capabilities known in the art, related art, or developed later. The first mobile phone 108 may be compatible with the second mobile phone 110 to exchange audio signals with each other or any other compatible devices. Each of the first mobile phone 108 and the second mobile phone 110 may be located at the same or different locations.

The server 112 may be implemented as any of a variety of computing devices including, for example, a general purpose computing device, multiple networked servers (arranged in clusters or as a server farm), a mainframe, or so forth. As shown in the embodiment of FIG. 1A, the server 112 may be installed, integrated, or operatively associated with the RSS device 114, which may be configured to perform realistic speech synthesis using text based on an accumulated speech data corpus of a user, such as the first user 104, who may be generating the text using a computing device, such as the first mobile phone 108. The server 112 may store the accumulated speech data corpus of the user in its stored data repository. For example, the first user 104 may send an email message using the first mobile phone 108 to the second user 106 on the second mobile phone 110. In order to listen to the received email message, the second user 106 may request the RSS device 114 to convert the text of the email message into synthesized speech. The RSS device 114 may be configured to add realism to the synthesized speech by providing synthesized speech that is identical or substantially identical to the voice of a user who is related to the text, e.g., the first user 104 who is the sender of the email message in this example. The RSS device 114 may be configured to generate such realistic synthesized speech based on a speech data corpus extracted and accumulated from a speech audio signal of the first user 104 over a predefined time period during previous voice interactions of the first user 104 with other users, such as the second user 106, over the network 102. The speech audio signal may include a set of words in a predetermined language having predefined speech sounds called phonemes. In some embodiments, the RSS device 114 may receive the speech audio signal live from the first user 104 using the first mobile phone 108.

Figure 1B:
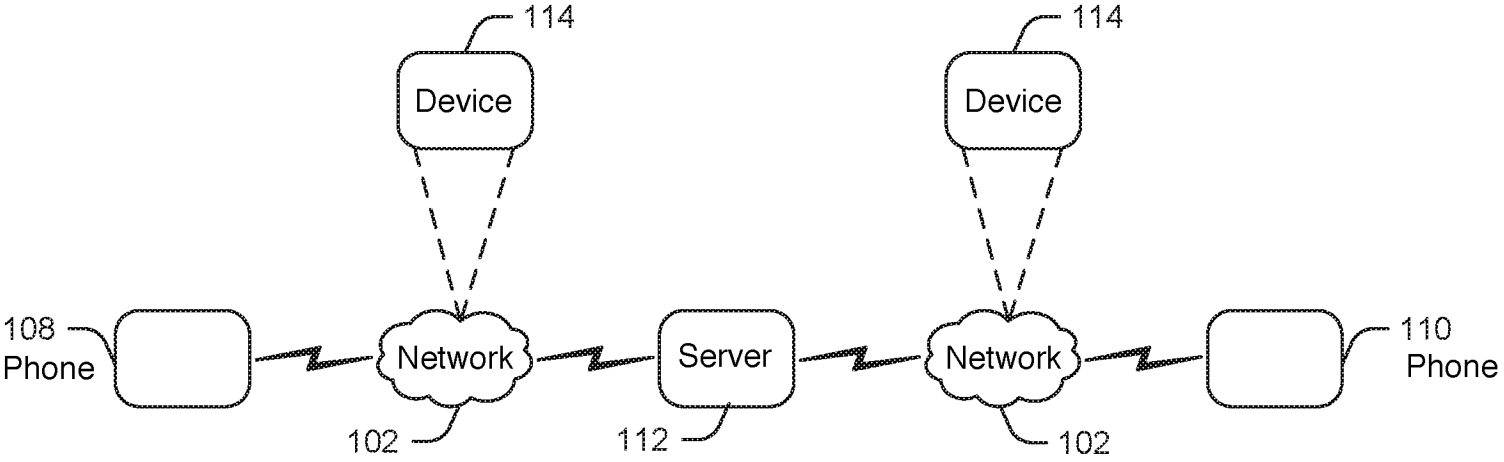

In some embodiments (as shown in FIG. 1B), the RSS device 114 may be installed on or integrated with a network appliance (not shown) configured to establish the network 102 between the first mobile phone 108 and the second mobile phone 110. One or more of the RSS devices 114 and the network appliance may be capable of operating as or providing an interface to assist exchange of software instructions and data among the first mobile phone 108, the second mobile phone 110, and the RSS device 114. In some embodiments, the network appliance may be preconfigured or dynamically configured to include the RSS device 114 integrated with other devices. For example, the RSS device 114 may be integrated with the server 112 (as shown in FIG. 1A) or any other computing device (not shown) connected to the network 102. The server 112 may include a module (not shown), which enables the server 112 being introduced to the network appliance, that enables the network appliance to invoke the RSS device 114 as a service. Examples of the network appliance include, but are not limited to, a DSL modem, a wireless access point, a router, a base station, and a gateway having a predetermined computing power and memory capacity sufficient for implementing the RSS device 114.

Figure 1C:
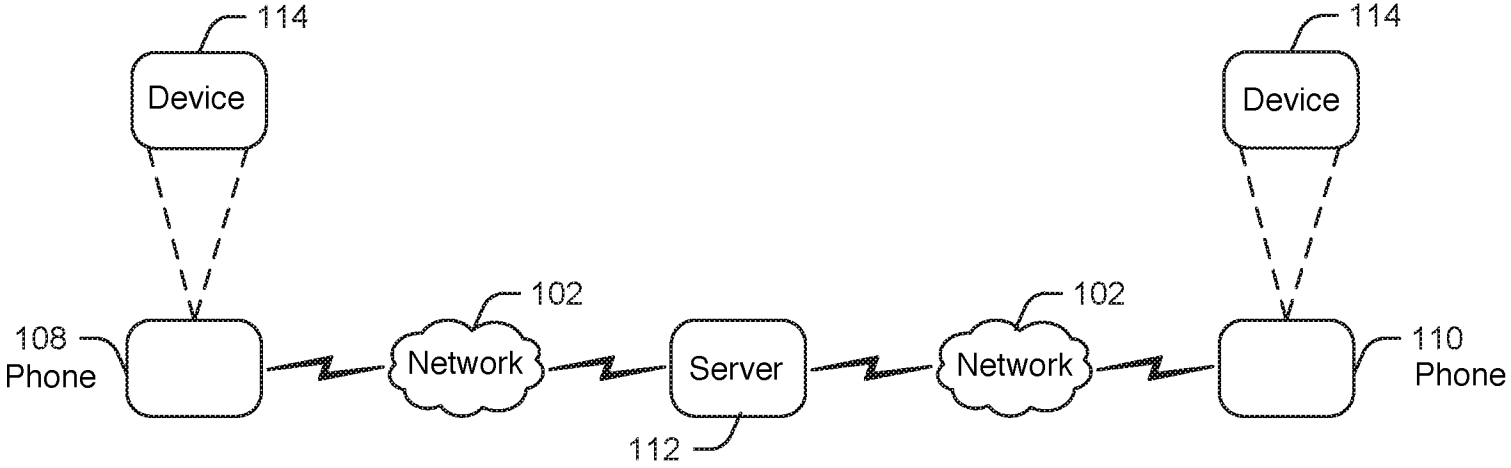

In another embodiment, as shown in FIG. 1C, the RSS device 114 may be integrated with one or more communication devices, such as the first mobile phone 108 and/or the second mobile phone 110.

Figure 1D:
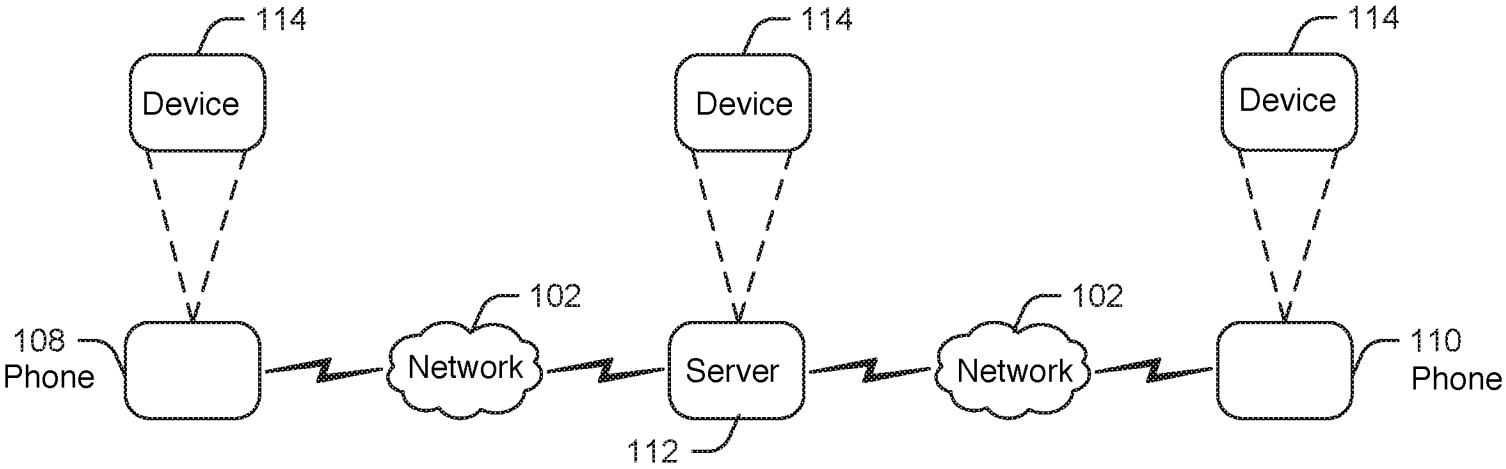

In yet another embodiment, as shown in FIG. 1D, the RSS device 114 may be integrated into any number of devices in a distributed fashion such as being integrated into one or more communication devices, such as the first mobile phone 108 and/or the second mobile phone 110, and in the server 112.

In some embodiments, the first mobile phone 108 may implement a variety of noise reduction techniques known in the art, related art, or developed later including the Ephraim and Malah algorithm for speech enhancement. For example, the first mobile phone 108 may pre-process the speech audio signal using such noise reduction techniques for sending pre-processed speech either directly to the RSS device 114 or via the server 112 implementing the RSS device 114. In some embodiments, the pre-processed speech audio signal may have relatively less noise compared to the original speech audio signal of the first user 104.

Alternatively, the RSS device 114 may be implemented as a software application or a device driver. The RSS device 114 may enhance or increase the functionality and/or capacity of the network, such as the network 102, to which it is connected. In some embodiments, the RSS device 114 may be configured to expose its computing environment or operating code to a user, and may include related art I/O devices, such as a keyboard or display. The RSS device 114 of some embodiments may, however, include software, firmware, or other resources that support remote administration and/or maintenance of the RSS device 114.

In further embodiments, the RSS device 114, in communication with any of the networked devices such as the first mobile phone 108 and the second mobile phone 110, or independently, may have voice and data communication capabilities (e.g., unified communication capabilities) by being coupled to or including various audio devices (e.g., microphones, music players, recorders, audio input devices, speakers, audio output devices, telephones, speakerphones, etc.), or any other type of hardware, in any combination thereof, capable of facilitating voice and data communications. In some embodiments, the RSS device 114 may be in communication with one or more imaging devices (e.g., cameras, printers, scanners, medical imaging systems, etc.) and one or more video devices (e.g., monitors, projectors, displays, televisions, video output devices, video input devices, camcorders, etc.).

In some embodiments, the RSS device 114 may comprise or implement one or more real time protocols and non-real time protocols known in the art, related art, or developed later to facilitate transfer of speech audio signals and data among the first mobile phone 108, the second mobile phone 110, the server 112, the RSS device 114, or any other network devices.

In some embodiments, the RSS device 114 may be configured to convert communications, which may include instructions, conversation, queries, data, etc., from the first mobile phone 108 into appropriate formats to make these communications compatible with the second mobile phone 110, and vice versa. Consequently, the RSS device 114 may allow implementation of the first mobile phone 108 or the server 112 using different technologies or by different organizations, e.g., a third-party vendor, managing the first mobile phone 108, or the server 112, or associated services using a proprietary technology.

Figure 2A:
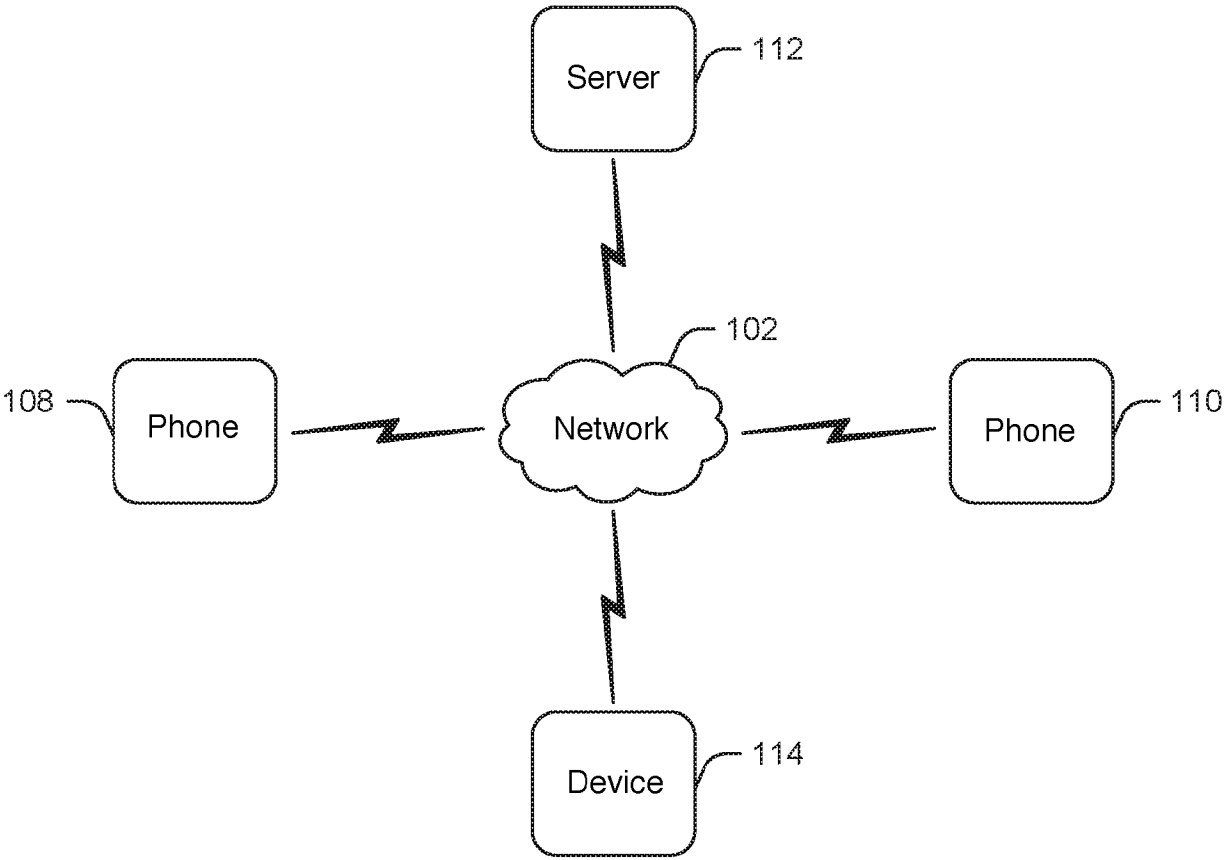
FIGS. 2A-2E are schematics that illustrate exemplary network environments for implementing the RSS device, where communication devices communicate with each other directly over a network.

FIGS. 2A-2E are schematics that illustrate exemplary network environments for implementing the RSS device 114, where communication devices communicate with each other directly over network 102, according to an embodiment of the present disclosure. The RSS device 114 may represent any of a wide variety of devices capable of providing speech synthesis services to network devices. The RSS device 114 may be implemented as a standalone and dedicated device (as shown in FIG. 2A) including hardware and installed software, where the hardware is closely matched to the requirements and/or functionality of the software. In this embodiment, the first mobile phone 108, the second mobile phone 110, the RSS device 114, and the server 112 may be in communication with one another over the network 102. The RSS device 114 may be installed on or integrated with a network appliance (not shown) configured to establish the network 102. The network 102 may be the cellular service provider's network which enables communication among its users via their mobile devices, such as the first mobile phone 108 and the second mobile phone 110. The first mobile phone 108 may send out the text to the second mobile phone 110 over the network 102, in turn the second mobile phone 110 may send the received text to the RSS device 114 for speech synthesis. The RSS device 114 may have access to the server 112 for the accumulated speech data corpus, in order to provide the synthesized speech based on the received text back to the second mobile phone 110.

Figure 2B:
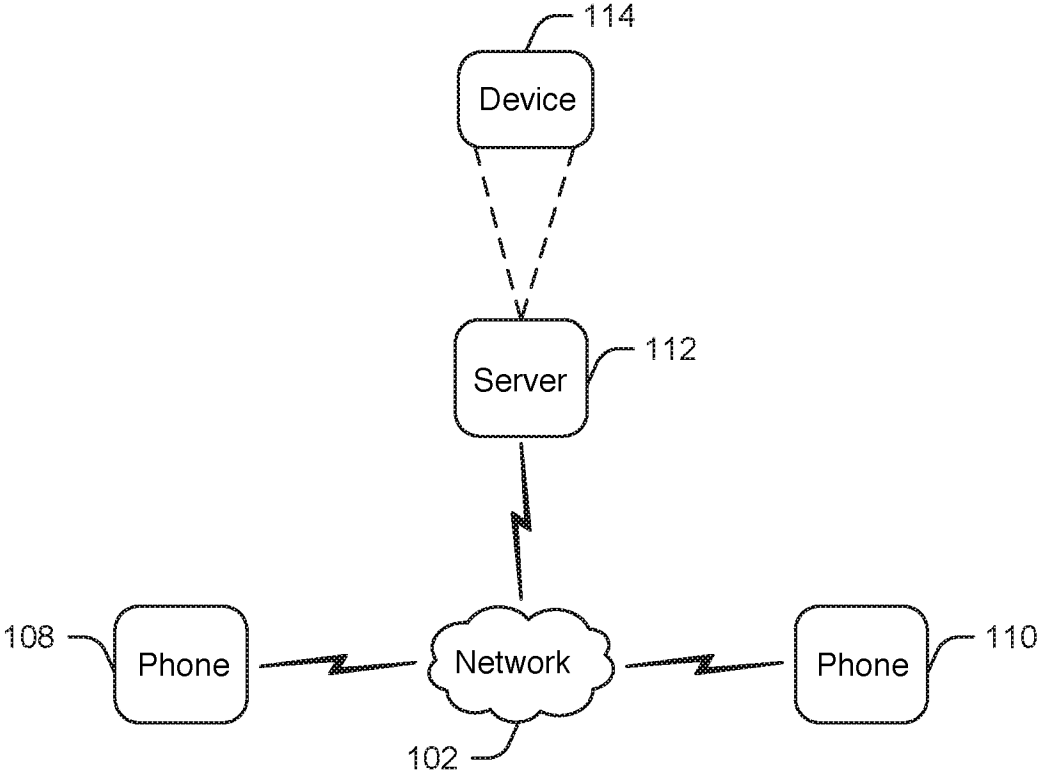

In one embodiment, as shown in FIG. 2B, the first mobile phone 108, the second mobile phone 110, and the server 112 may be in communication with each other over the network 102. The RSS device 114 may be installed on or integrated with the server 112.

Figure 2C:
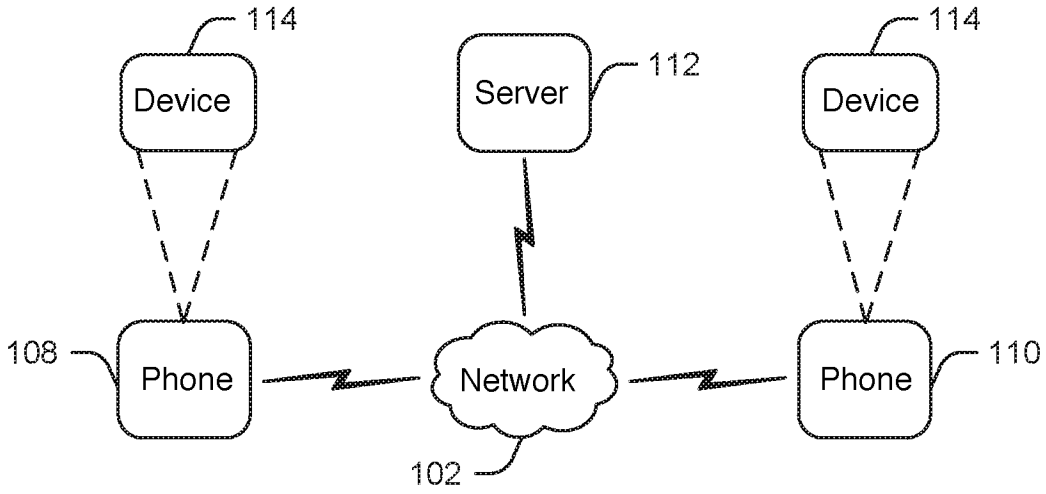

In another embodiment, as shown in FIG. 2C, the RSS device 114 may be installed on or integrated with one or more communication devices such as the first mobile phone 108 and the second mobile phone 110.

Figure 2D:
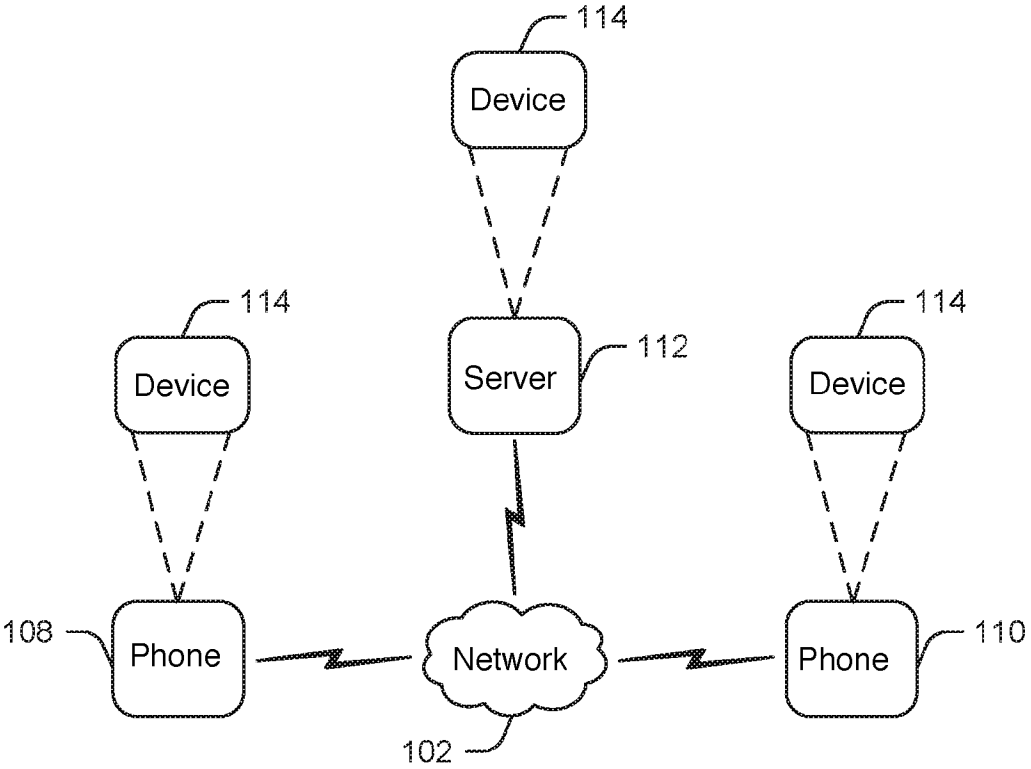

In yet another embodiment, as shown in FIG. 2D, the RSS device 114 may be integrated with any number of devices in a distributed fashion such as being integrated with or installed on the communication devices, e.g., the first mobile phone 108 and the second mobile phone 110, and the server 112.

Figure 2E:
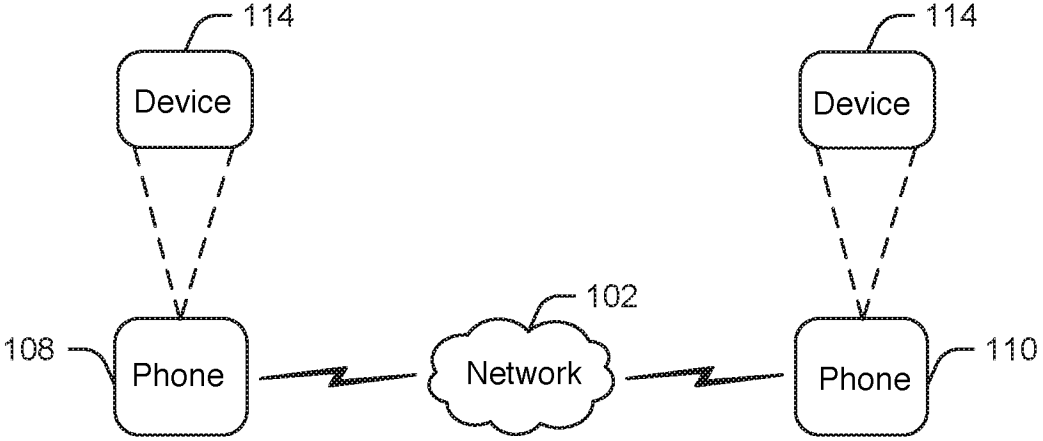

In a further embodiment, as shown in FIG. 2E, the RSS device 114 may be installed on or integrated with the communication devices such as the first mobile phone 108 and the second mobile phone 110, which are in direct communication with each other over the network 102 without the server 112. Each of the first mobile phone 108 and the second mobile phone 110 may include one or more processors and various types of memory and storage devices that are typically found in a variety of user communication devices and user computing devices known in the art, related art, or developed later.

Figure 3:
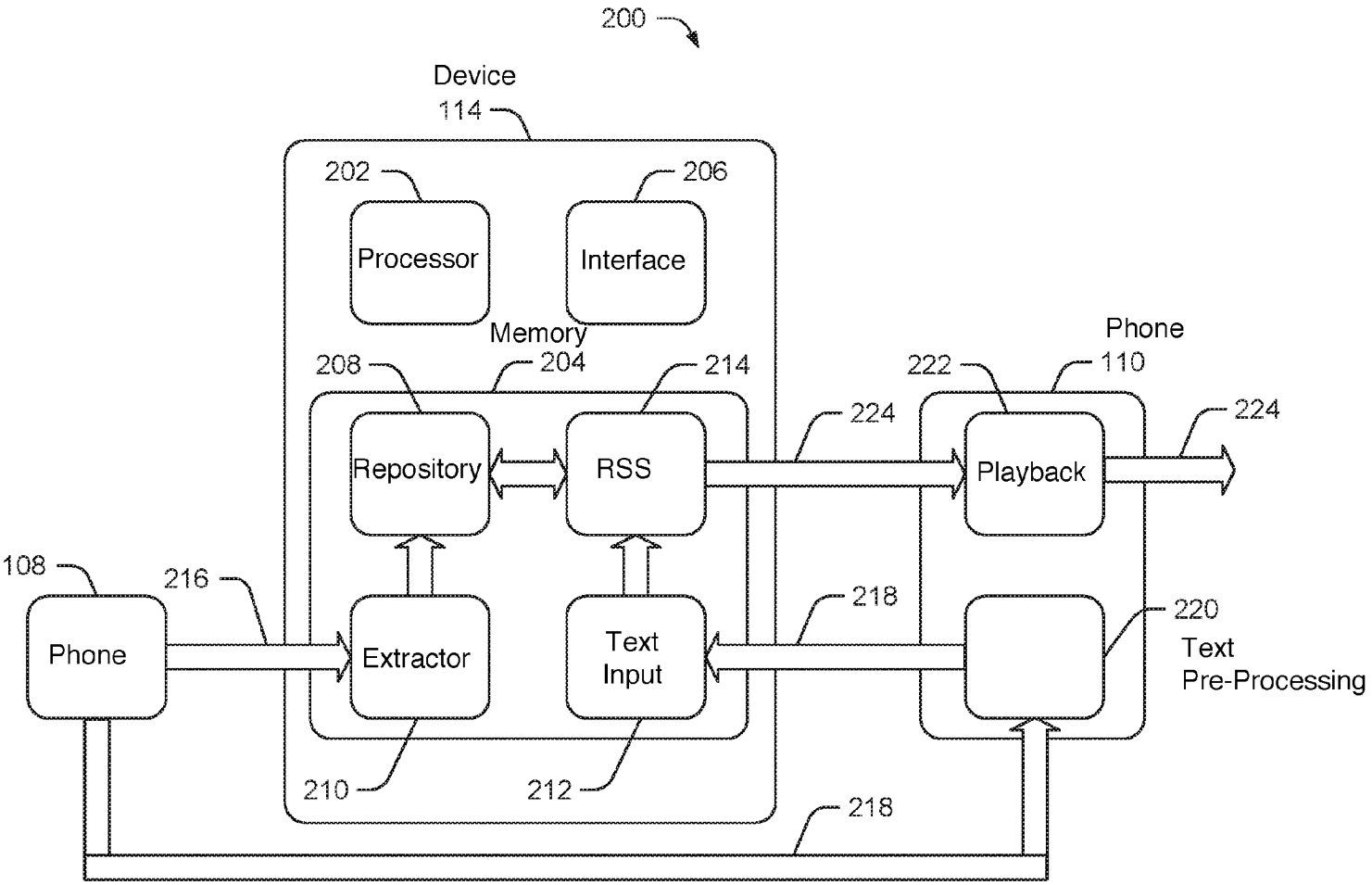
FIG. 3 illustrates an RSS system implementing the RSS device.

As illustrated in FIG. 3, an RSS system 200 includes the RSS device 114 that may be configured for realistic speech synthesis using text based on the speech data corpus of a user, such as the first user 104, who may be related to or associated with the text. The RSS device 114 may be implemented by way of a single device (e.g., a computing device, a processor or an electronic storage device) or a combination of multiple devices that are operatively connected or networked together. The RSS device 114 may be implemented in hardware or a suitable combination of hardware and software. In some embodiments, the RSS device 114 may be a hardware device including processor(s) 202 executing machine readable program instructions for analyzing data, and interactions between the first mobile phone 108 and the second mobile phone 110. The "hardware" may comprise a combination of discrete components, an integrated circuit, an application-specific integrated circuit, a field programmable gate array, a digital signal processor, or other suitable hardware. The "software" may comprise one or more objects, agents, threads, lines of code, subroutines, separate software applications, two or more lines of code or other suitable software structures operating in one or more software applications or on one or more processors. The processor(s) 202 may include, for example, microprocessors, microcomputers, microcontrollers, digital signal processors, central processing units, state machines, logic circuits, and/or any devices that manipulate signals based on operational instructions. Among other capabilities, the processor(s) 202 may be configured to fetch and execute computer readable instructions from a memory 204 associated with the RSS device 114 for performing tasks such as signal coding, data processing input/output processing, power control, and/or other functions.

In some embodiments, the RSS device 114 may include, in whole or in part, a software application working alone or in conjunction with one or more hardware resources. Such software applications may be executed by the processor(s) 202 on different hardware platforms or emulated in a virtual environment. Aspects of the RSS device 114 may leverage known, related art, or later developed off-the-shelf software. Other embodiments may comprise the RSS device 114 being integrated or in communication with a mobile switching center, network gateway system, Internet access node, application server, IMS core, service node, or some other communication systems, including any combination thereof. In some embodiments, the RSS device 114 may be integrated with or implemented as a wearable device including, but not limited to, a fashion accessory (e.g., a wrist band, a ring, etc.), a utility device (a hand-held baton, a pen, an umbrella, a watch, etc.), an article of clothing, or any combination thereof.

The RSS device 114 may include one or more of a variety of known, related art, or later developed interface(s) 206, including software interfaces (e.g., an application programming interface, a graphical user interface, etc.); hardware interfaces (e.g., cable connectors, a keyboard, a card reader, a barcode reader, a biometric scanner, a microphone, a camera, an interactive display screen, etc.); or both.

The RSS device 114 may further include the memory 204 for storing at least one of (1) a log of profiles of network devices, device owners, and associated communications including instructions, queries, conversations, data, and related metadata; (2) information related to one or more subscribers of a predefined service (e.g., a speech font service, etc.) being provided by or implemented on the network 102; (3) a speech data corpus, e.g., recorded speech along with a time-aligned textual transcription, of one or more network users or speech font service subscribers such as the first user 104; and (4) predefined models, equations, algorithms, etc. for speech recognition and speech synthesis.

The system memory 204 may comprise any computer-readable medium known in the art, related art, or developed later including, for example, volatile memory (e.g., RAM), non-volatile memory (e.g., flash, etc.), disk drive, etc., or any combination thereof. The system memory 204 may include one or more stored data repositories such as a stored data repository 208, which may include a database and/or a file system that may be sub-divided into further databases and/or files for storing electronic files. The system memory 204 may have one of many stored data repository schemas known in the art, related art, or developed later for storing speech data, such as a speech data corpus, from the first mobile phone 108. For example, the stored data repository 208 may have a relational stored data repository schema involving a primary key attribute and one or more secondary attributes. In some embodiments, the RSS device 114 may perform one or more operations, but not limited to, reading, writing, indexing, labeling, updating, and modifying the data, and may communicate with various networked computing devices.

In one embodiment, the system memory 204 may include various modules such as a speech data extractor 210, the stored data repository 208 for storing the speech data corpus of one or more speech font service subscribers or network users, a text input module 212, and an RSS unit 214. The speech data extractor 210 may include a predefined threshold of the signal-to-noise ratio (SNR), hereinafter referred to as predefined SNR threshold, for a received speech audio signal 216, e.g., from the first mobile phone 108. In one embodiment, the speech data extractor 210 may be configured to record the speech audio signal 216 having an acceptable signal to noise ratio (SNR), which is above the predefined SNR threshold. Such speech audio signal 216 may be recorded over time while the user device such as the first mobile phone 108 is being used in communication over the network 102. The recorded speech audio signal 216 may be stored in the stored data repository 208 as such or after being transcribed into text, or both.

In some embodiments, the first mobile phone 108 may enable the first user 104 to record the speech audio signal 216 in multiple small portions at a user device, such as the first mobile phone 108, in a relatively quiet environment. Each of the small portions of the recorded speech audio signal 216, in one example, may be transcribed into textual speech data at the user device over a predetermined duration or a predefined size of each such small portion. Upon conversion, the user device may send the textual speech data corresponding to each such small portion to the speech data extractor 210, which may store the textual speech data in the stored data repository 208 for the purpose of collecting a speech data corpus.

In some embodiments, the speech data extractor 210 may record the speech audio signal 216, which may be received from a voice mail system. The speech data extractor 210 may transcribe the speech audio signal 216 into text, which may be stored in the stored data repository 208 to create the received speech data corpus for different users based on the configuration of the RSS device 114. In one example, the speech data extractor 210 may create the speech data corpus only for users who have subscribed to a particular service such as the speech font service provided by the RSS device 114. In another example, the speech data extractor 210 may create the speech data corpus for users who communicate using the same network such as the network 102 to which the RSS device 114 is connected. In yet another example, the speech data extractor 210 may create the speech data corpus for users who have provided authorization for such recording, transcribing, or storing being performed.

If the user approves usage of their speech audio signal 216, the speech audio signal 216 may be recorded and the corresponding speech data corpus may be captured in the stored data repository 208 over a predetermined time period, e.g., few weeks to few months, as the user such as the first user 104 normally uses the first mobile phone 108. Subsequently at the end of such predetermined time period, the first user 104 may be given an opportunity to listen to the recorded speech audio signal 216 rendered in their voice prior to making their speech font available to anyone else.

The speech data extractor 210 may implement any of a variety of techniques known in the art, related art, or developed later in order to extract the speech data corpus. In one approach, the speech data extractor 210 may record the compressed speech data stream from a user's mobile phone conversation. In another approach, the speech data extractor 210 may implement an automatic speech recognition system that may transcribe the recorded speech audio signal 216 into text and may tag the transcribed text with labels, e.g., based on inherent part of speech (POS) and noun phrases using any of a variety of natural language processing (NLP) techniques known in the art, related art, or developed later such as conditional random field models. Tagging may allow segments of the recorded speech audio signal 216 to be matched with the transcribed text so that sub-word segments can be captured in the stored data repository 208. Such textual speech data may be accumulated over time to create the speech data corpus for one or more users such as the first user 104 in the stored data repository 208. Such transcription to text may not be absolutely accurate; however, the goal is only to identify segments of speech that sound like the transcribed text. Subsequently, the speech data extractor 210 may extract a speech font including prosody information and accent from the speech data corpus corresponding to the user such as the first user 104 using any of a variety of algorithms known in the art, related art, or developed later.

In some embodiments, the speech data extractor 210 may be configured to automatically determine whether or not a user such as the first user 104 whose speech audio signal 216 is received from the first mobile phone 108 is the actual service subscriber. For example, the speech data extractor 210 may compare the speech audio signal 216, as received by the speech data extractor 210 from the first mobile phone 108, with a synthetic speech intermediately generated by the RSS unit 214 using the textual speech data extracted from the speech audio signal 216 by the speech data extractor 210, where the textual speech data may have been stored in the stored data repository 208 if the first user 104 is the actual service subscriber. A positive match based on such comparison may confirm that the first user 104 who corresponds to the received speech audio signal 216, is the actual subscriber of the predefined service, e.g., speech font service, provided by or implemented on the network 102 or the RSS device 114.

Additionally, the speech data extractor 210 may be configured to determine the identity of the user from the list of service subscribers stored in the stored data repository 208 using a variety of speaker identification techniques known in the art, related art, or developed later. For example, the speech data extractor 210 may compute the Itakura-Saito distance between the intermediate synthetic speech generated by the RSS unit 214 for each of the service subscribers stored in the stored data repository 208 and the speech audio signal 216 received from a user such as the first user 104. The service subscriber for whom the computed Itakura-Saito distance is the lowest can be identified as the true speaker of the received speech audio signal 216 or the first user 104. The textual speech data of the received speech audio signal 216 for the first user 104, identified as the true speaker, may be stored as the speech data corpus for the first user 104 in the stored data repository 208.

Since a large stored data repository of speech sounds may be acquired, an uncompressed raw speech data corpus may exceed 130 Megabytes for each user. Even if a modern speech compression codec may be used, the amount of storage required for several high quality synthesis speech fonts may be very large. Hence, the stored data repository 208 storing the accumulated speech data corpus for different users may be located on the server 112 rather than on a mobile device such as the first mobile phone 108 or the second mobile phone 110.

The text input module 212 may be in communication with a user device such as the second mobile phone 110. The text input module 212 may be configured to receive text 218 in any form such as an email message, SMS message, an electronic document, and so on that needs to be converted into speech from the second mobile phone 110. The received text 218 may be sent to the RSS unit 214 for being converted into a realistic synthetic speech in response to the speech data corpus of a user (e.g., the first user 104 or the second user 106) related with the text 218. In some embodiments, the text input module 212 may be configured to convert the text 218 received in one language into another language using any of a variety of techniques known in the art, related art, or developed later. For example, the text input module 212 may convert an English text 218 received in an electronic document into a text in the Spanish language and send the Spanish text to the RSS unit 214 for being converted into the realistic synthetic speech.

The RSS unit 214 may receive the text 218 from the text input module 212 and may be configured to generate realistic synthetic speech using the stored speech data corpus of one of the users related to the text 218 according to an RSS request by the second user 106 using the second mobile phone 110.

Such speech data corpus may be available in the stored data repository 208 for (1) users who have subscribed to the speech font service, such users also referred to as service subscribers; (2) users who communicate using the network 102; (3) users who have provided authorization for such storing or recording their speech audio signal 216 or speech data corpus; or any combination thereof, based on settings of the RSS device 114 configured by an administrator of a network such as the network 102 over which the first mobile phone 108, the second mobile phone 110, and the RSS device 114 are in communication with each other. Additionally, the RSS unit 214 may determine a relation between the text 218 or related electronic document and a user such as the first user 104 by comparing metadata of the text 218 or related electronic document with profiles of network users or service subscribers that may be stored in the stored data repository 208 or received on-the-fly from an external stored data repository or device. Examples of metadata may include, but not limited to, email address, contact number, unique voice stamp, photograph, and digital signature. Each user profile may include information such as those mentioned above for the metadata. Upon such comparison, the RSS unit 214 may identify a user related to the text 218 or related document. In some embodiments, by default, the RSS unit 214 may identify a user, such as the second user 106, from whom the text 218 or related electronic document is received as the user related to that text 218 or related electronic document.

In one embodiment, the RSS unit 214 may convert the received text 218 into "tokens" and eliminate symbols that cannot be spoken aloud like spaces, punctuation symbols, and special characters. In some embodiments, the text 218 that can be spoken may also be separated from other information, such as phone numbers and URLs.

The RSS unit 214 may then determine how to pronounce a sequence of words of the text 218 by determining what part of speech each word can be classified into and how the words are organized into logical groups. For example, the correct pronunciation of the words "record", "permit", and "present" depends heavily on how the word is used in a specific sentence. At this point, the output is a set of "graphemes" or letters of the alphabet plus information on how each word should be pronounced.

The graphemes or the stream of data that describes how a word should be pronounced may be taken and a set of phonemes may be selected from a recorded stored data repository 208 of speech sounds or speech fonts that may be used to speak the word aloud. Phonemes are the set of speech sounds available for use in a particular language. Further the RSS unit 214 may determine prosody information that describes elements like emphasis, pauses, and pitch for a set of phonemes. In some embodiments, the RSS unit 214 may determine the prosody information for a user such as the first user 104 identified to be related to the text 218 or related electronic document. The RSS unit 214 may automatically extract speech patterns from speech segments in the speech data corpus retrieved from the speech audio signal 216 of the first user 104 by the speech data extractor 210 and stored in the stored data repository 208. The speech pattern information may include the prosody information and accent of the user such as the first user 104.

In one instance, the RSS unit 214 may implement the concatenative synthesis method that uses the recorded stored data repository 208 of these speech segments or sounds (diphones or triphones) corresponding to the user, such as the first user 104, identified to be related to the received text 218 and concatenates the correct pieces of speech sounds or phonemes to generate a continuous speech.

The prosody information may include inter-word timing and pauses, patterns of stress and emphasis, intonation, and other synthesis parameters from the extracted speech pattern information of the identified user to make the synthetic speech sound more natural and realistic. In some embodiments, the RSS unit 214 may audio-watermark the generated realistic synthetic speech, so that it can be verified to be synthetic, rather than the actual or live voice of the user related to the text 218 or related electronic document, by the RSS unit 214 or the second mobile phone 110, or any other network module or device.

In some embodiments, the RSS unit 214 may be configured to use emoticons embedded in the text 218, e.g., at the end of a sentence, such that the emoticons provide cues to the RSS unit 214 via the text input module 212 regarding the intonation, playback speed, or additional sound effects to be used. For example, if a wink emoticon is used at the end of a sentence, a short and high pitched bell sound ("dink") may be added to indicate the wink in the corresponding realistic synthetic speech generated by the RSS unit 214 for the text 218. Such embodiments may be available as a user configurable option in the second mobile phone 110 and may allow a user, such as a speech font owner, to record a specific sound and associate that sound with an emoticon. The RSS unit 214 may combine previously extracted speech patterns and synthesis parameters for a particular user, e.g., the first user 104, as a customized "speech font" with the emoticons embedded in the text 218 for generating the realistic synthesized audible speech that sounds like the first user 104 from whose speech data corpus the speech font was extracted.

In some embodiments, the network administrator or provider managing the RSS device 114 may also provide a library of previously captured speech fonts for a small fee. For example, emails from a particular user might be made to sound like known personalities such as Bart Simpson, William Shatner, or Meryl Streep. The RSS device 114, or the user may configure the RSS device 114, to set email or texts 218 from a specific address, e.g., email address, device IP address, postal address of the message sender, and so on, to be read in a selected speech font from a variety of speech fonts available in the library of available fonts on the RSS device 114. The user such as the second user 106 may access the speech fonts based on their library subscription, authorized passwords, or any other suitable engagement or arrangement with the network provider or administrator, or the font owner.

In one embodiment, the second mobile phone 110 may communicate with the RSS device 114 using a variety of techniques known in the art, related art, or developed later for listening to a text 218 received from the first mobile phone 108. The RSS device 114, may include a text pre-processing unit 220 and a playback unit 222.

The text pre-processing unit 220 may receive text 218 or related electronic document from a user device such as the first mobile phone 108 and send the text 218 received as such or in an electronic document to the text input module 212 of the RSS device 114. In some embodiments, the text pre-processing unit 220 may be configured to expand common abbreviations in a text 218 message based on a variety of public, private, or proprietary stored data repositories of abbreviations known in the art, related art, or developed later. For example, "aml" may expand to "all my love", "atb" may expand to "all the best", "bmgwl" may expand to "busting my gut with laughter", "c % l" may expand to "cool", and so on that may be programmed into the text pre-processing unit 220. The text pre-processing unit 220 may alternatively look up in any of the stored data repositories of abbreviations. In some embodiments, the text pre-processing unit 220 may be integrated with the RSS device 114.

The playback unit 222 may in communication with the RSS unit 214 on the RSS device 114 and a speaker on the second mobile phone 110. The playback unit 222 may receive and playback the realistic synthetic speech 224 from the RSS unit 214.

In some embodiments, in order to read the text 218 such as an email message aloud, a user such as the second user 106 may open the message and select a 'read aloud' option in a task menu (not shown) of the second mobile phone 110. Upon selection, the second mobile phone 110 may establish a communication link with the RSS device 114 with a technique of dial tone and ring back silenced call or any other technique known in the art, related art, or developed later. The email message that the user wants to have read audibly may be streamed from the second mobile phone 110 to the RSS device 114 via the text pre-processing unit 220. Subsequently, the realistic synthetic speech 224 may be rendered using the speech font related to a sender of the email message, where the sender may be identified by comparing the email address associated with the email message with various profiles of network users and service subscribers in the stored data repository 208. The realistic synthetic speech 224 rendered by the RSS unit 214 may be received by the second mobile phone 110 via the playback unit 222 for playback. However, use of the speech font may be under control of a user, hereinafter referred to as font owner, from whose speech audio signal 216 (or speech data corpus) the speech font was extracted by the RSS unit 214. Such security feature may allow only authorized users to apply that speech font of the font owner to generate audible and realistic synthetic speech resembling voice of the font owner. In one example, the speech font may be password protected.

The person whose voice is being captured to create the speech font, or the font owner, may apply a password protection to that speech font. The password may be communicated (e.g., in an email message, an SMS message, or on a social media platform, etc.) to an intended user or recipient of such email, such as the second user 106, who may want to have the email being audibly read using the speech font (or voice font) of the font owner. In one example, the password may be entered, e.g., as a touch-tone key sequence, by the second user 106 only once during a setup phase. The password may authenticate a particular phone number of the second user 106 so that future requests for realistic speech synthesis using the same speech font from that same phone number may be fulfilled automatically by verifying the caller identity (ID) of the requester such as the second user 106.

The silenced call initiated by the second mobile phone 110 with the RSS device 114 may be left open by the second mobile phone 110 or the RSS device 114 for a predetermined duration, e.g., a couple of minutes, after the message playback has ended. Such extended connection with the RSS device 114 may allow the second mobile phone 110 immediately be able to again listen to the email message such as the text 218, or another message using a realistic synthesized speech based on the specific speech font of a user, such as the first user 104, related to the email message.

Figure 4:
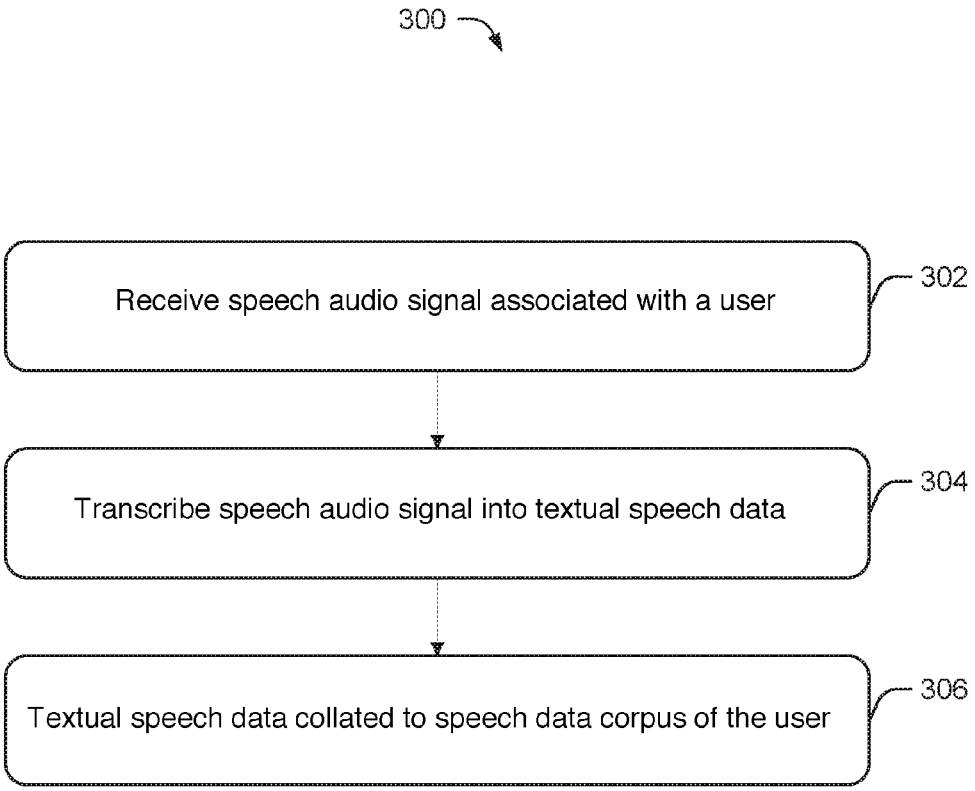
FIG. 4 is a flowchart illustrating an exemplary method being implemented by the RSS device.

FIG. 4 is a flowchart illustrating an exemplary method being implemented by the RSS device 114, according to an embodiment of the present disclosure. The exemplary method 300 may be described in the general context of computer executable instructions. Generally, computer executable instructions may include routines, programs, objects, components, data structures, procedures, modules, functions, and the like that perform particular functions or implement particular data types. The computer executable instructions may be stored on a computer readable medium, and installed or embedded in an appropriate device for execution.

The order in which the method 300 is described is not intended to be construed as a limitation, and any number of the described method blocks may be combined or otherwise performed in any order to implement the method, or an alternate method. Additionally, individual blocks may be deleted from the method without departing from the spirit and scope of the present disclosure described herein. Furthermore, the method 300 may be implemented in any suitable hardware, software, firmware, or combination thereof, that exists in the related art or that is later developed.

The method 300 describes, without limitation, implementation of the exemplary RSS device 114. Those having ordinary skill in the art would understand that the method 300 may be modified appropriately for implementation in a various manners without departing from the scope and spirit of the disclosure.

At step 302, a speech audio signal associated with a user is received. The RSS device 114 may receive a speech audio signal such as the speech audio signal 216 from a communication device such as the first mobile phone 108 over the network 102. The speech audio signal may belong to a user such as the first user 104 and include a set of specific words in a predetermined language in the voice of the user 104. In one embodiment, the speech audio signal may be received live from the first user 104 via the first mobile phone 108; however in other embodiments, the speech audio signal 216 may be a recorded speech audio signal received from a voice mailbox of the first user 104. In some embodiments, the speech audio signal 216 may be pre-processed by the first mobile phone 108 to reduce background noise using any of the variety of noise reduction techniques known in the art, related art, or developed later.

At step 304, the received speech audio signal is transcribed into textual speech data. The received speech audio signal may be recorded to generate a recorded speech audio signal, which may be stored in the stored data repository 208. The recorded speech audio signal may be transcribed into textual speech data, which includes a speech font of a user such as the first user 104. The speech font refers to a speech pattern that includes prosody information (e.g., inter-word timing and pauses, patterns of stress and emphasis, intonation, speech playback speed, pitch, etc.) and accent of a user such as the first user 104, who may also be referred to as a speech font owner. In some embodiments, the RSS device 114 may be configured to perform such recording, conversion, or storage of one or more aspects of the speech audio signal corresponding to a user such as the first user 104 upon receiving an authorization from the speech font owner, i.e., the first user 104.

In some embodiments, the textual speech data may be tagged with a label, e.g., based on inherent part of speech (POS) and noun phrases using any of a variety of natural language processing (NLP) techniques known in the art, related art, or developed later such as conditional random field models. The RSS device 114 may compare the tagged textual speech data with segments of the recorded speech audio signal to capture those segments, hereinafter referred to as correct segments, which have a positive match upon such comparison.

At step 306, the textual speech data is collated to create a speech data corpus of the user. The textual speech data containing the correct segments is stored in the stored data repository 208. Over time, multiple textual speech data segments may be retrieved from a user device, such as the first mobile phone 108, and accumulated to create a speech data corpus of a user such as the first user 104. Similarly, the RSS device 114 may accumulate the speech data corpus for multiple users.

In one embodiment, the RSS device 114 may associate one or more emoticons with a specific sound or prosody information, or both, automatically or upon a request from a speech font owner. For example, the RSS device 114 may associate a short and high-pitched bell sound and a predetermined prosody information with a wink emoticon, which may be then stored in the stored data repository 208. Such an emoticon is capable of modulating, substantially or partially, a speech font in a predefined or dynamically defined manner. In some embodiments, the speech font owner may record a specific sound using the RSS device 114 via his own user device such as the first mobile phone 108 for that sound to be associated with an emoticon. In some other embodiments, the RSS device 114 may extract the speech font from the speech data corpus of each user to create a library of speech fonts, where such library is stored in the stored data repository 208.

Figure 5:
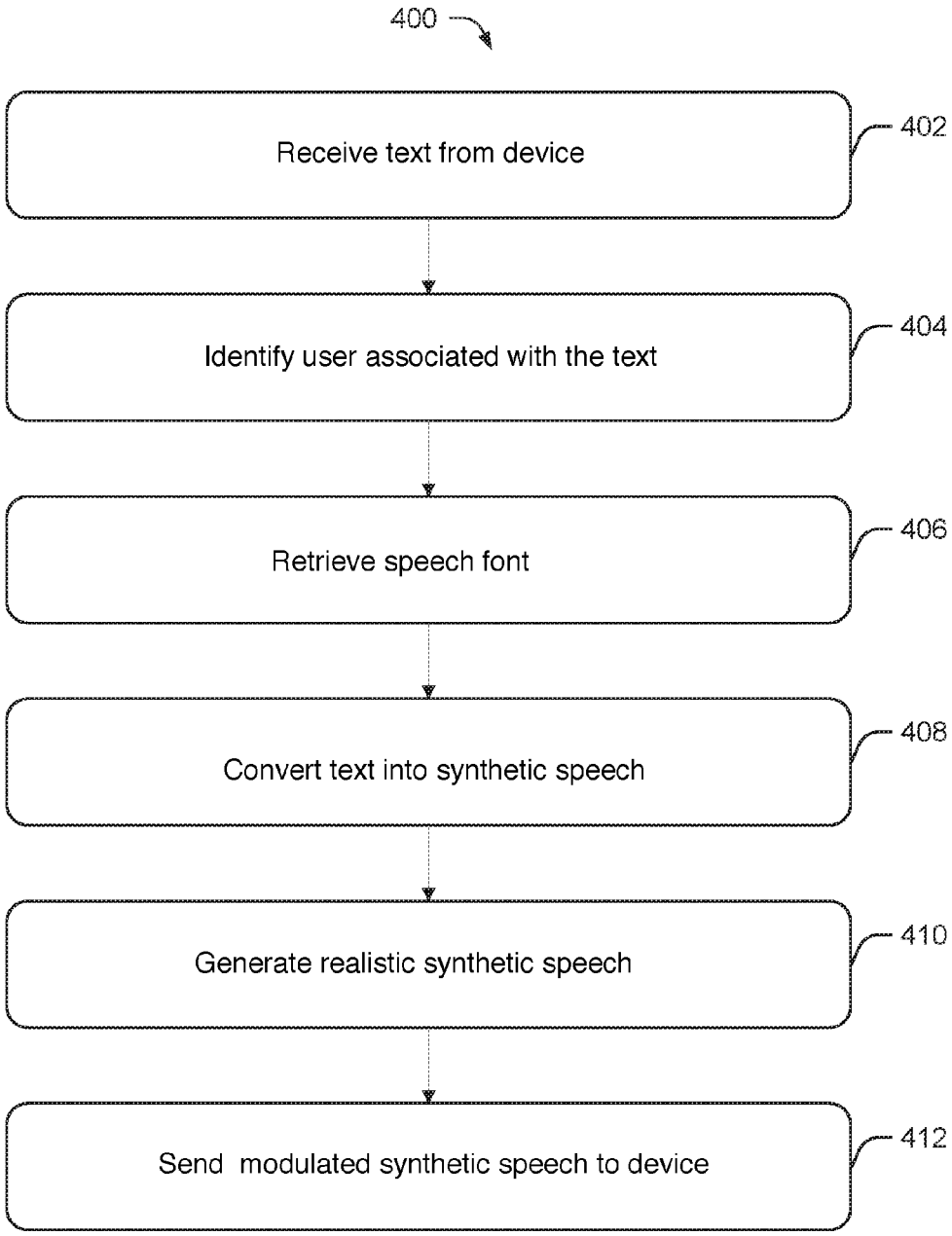
FIG. 5 is a flowchart illustrating an exemplary method being implemented by the RSS device.

FIG. 5 is a flowchart illustrating an exemplary method being implemented by the RSS device 114, according to an embodiment of the present disclosure. The exemplary method 400 may be described in the general context of computer executable instructions. Generally, computer executable instructions may include routines, programs, objects, components, data structures, procedures, modules, functions, and the like that perform particular functions or implement particular data types. The computer executable instructions may be stored on a computer readable medium, and installed or embedded in an appropriate device for execution.

The order in which the method 400 is described is not intended to be construed as a limitation, and any number of the described method blocks may be combined or otherwise performed in any order to implement the method, or an alternate method. Additionally, individual blocks may be deleted from the method without departing from the spirit and scope of the present disclosure described herein. Furthermore, the method 400 may be implemented in any suitable hardware, software, firmware, or combination thereof, that exists in the related art or that is later developed.

The method 400 describes, without limitation, implementation of the exemplary RSS device 114. Those having ordinary skill in the art would understand that the method 400 may be modified appropriately for implementation in a various manners without departing from the scope and spirit of the disclosure.

At step 402, a text is received from a second communication device that has received the text from a first communication device. In one embodiment, a first communication device such as the first mobile phone 104 may send a text to a second communication device such as the second mobile phone 110 over the network 102. The text may be in any natural language (e.g., English, Spanish, Sanskrit, Hebrew, Arabic, etc.) known in the art or developed later and encapsulated in any of a variety of mediums known in the art, related art, or developed later including an email message, an SMS message, and so on. The text may be associated with a user, whose information may be embedded as metadata, hereinafter referred to as text metadata, in the text or associated media. For example, an email message, which includes a text being sent from the first mobile phone 108 to the second mobile phone 110, may be embedded with sender's information as text metadata. Examples of the text metadata may include, but not limited to, sender's email address, an IP (internet protocol) address of the first communication device such as the first mobile phone 108, digital signature of the sender, sender's photograph, and so on.

The second communication device such as the second mobile phone 110 may pre-process the text using the text pre-processing unit 220 upon receiving the text from the first communication device. The text pre-processing unit 220 may be configured to expand abbreviations in the text based on a variety of public, private, or proprietary abbreviation stored data repositories known in the art, related art, or developed later. For example, the text pre-processing unit 220 may expand "aml" to "all my love", "atb" to "all the best", "bmgwl" to "busting my gut with laughter", "c % l" to "cool", and so on by referring to any of the abbreviation stored data repositories. In some embodiments, the text pre-processing unit 220 may be integrated with the RSS device 114 so that such pre-processing of the text may be performed at the RSS device 114. In one embodiment, the text may include any of a variety of emoticons known in the art, related art, or developed later.

The second communication device such as the second mobile phone 110 may establish a communication link with the RSS device 114 using different techniques, e.g., dial tone and ring back silenced call, over the network 102 and send the pre-processed text along with the embedded text metadata to the RSS device 114 via various mediums (e.g., email, SMS, social media platform such as Facebook®, etc.). In some embodiments, the RSS device 114 may translate the text into a predetermined natural language using the text input module 212. For example, the text input module 212 may translate text received in the Spanish language from the second mobile phone 110 into English language text.

At step 404, a user associated with the text is identified. The RSS device 114 may send the received text to the RSS unit 214, which may be configured to identify a user associated with the text automatically or based on a particular request received from the second mobile phone 110 for a specific user to be identified among a set of users associated with the text. In one example, the RSS unit 214 may compare text metadata with various user profiles stored in the stored data repository 208 to identify the user, such as the first user 104, who may be the original sender of the text. Each of the user profiles may include information of a respective user such as name, phone number, email address, IP address of an assigned communication device, digital signature, photograph, and so on.

At step 406, a speech font is retrieved from the stored data repository 208 corresponding to the identified user. Upon identifying the user associated with the text, the RSS unit 214 may retrieve a speech font of the user from the stored data repository 208. The speech font may be extracted from a speech data corpus of the identified user or from the library of speech fonts corresponding to the identified user. In some embodiments, the identified user being a font owner may control access to the speech font that belongs to him. For example, the speech font may be audio water-marked by the user (or the speech font owner) so that the RSS unit 214 recognizes that speech font is secure and therefore, requests an authorization key (e.g., a numeric, alphanumeric, or symbolic password; voice input; dual tone multi-frequency (DTMF) input, etc. or any combination thereof) from the identified user to access his speech font. In one instance, the RSS unit 214 may receive the authorization key along with the text or associated media such as an email message from the second mobile phone 110. In another instance, the RSS unit 214 may dynamically request the second mobile phone 110 (i.e., associated second user 106) or the first mobile phone 108 (i.e., associated first user 104) for the authorization key to access the speech font of the identified user.

At step 408, the text is converted into synthetic speech based on the retrieved speech font. The RSS unit 214 may be configured to convert the text into synthetic speech based on the retrieved speech font corresponding to the identified user, e.g., a sender of the email message containing the text, using any of the techniques known in the art, related art, or developed later including concatenative speech synthesis. In one embodiment, the retrieved speech font may be modulated by the RSS unit 214 based on the emoticons in the text to generate realistic synthetic speech at step 410. The RSS unit 214 may retrieve the prosody information and a specific sound, if any, stored in the stored data repository 208 for each emoticon in the text and accordingly modulate the retrieved speech font for adding realism to the generated synthetic speech. For example, if a sentence in the text ends with a wink emoticon, the RSS unit 214 may be configured to retrieve a corresponding prosody information and any specific sound such as a bell sound from the stored data repository 208 and apply them to the speech font based on which the synthetic speech is generated to generate realistic synthetic speech.

At step 412, the RSS unit 214 may send the modulated synthetic speech to the second communication device such as the second mobile phone 110 over the network 102 for the realistic synthetic speech to be played at the second mobile phone 110. After the realistic synthetic speech is sent, the communication link between the RSS device 114 and the second mobile phone 110 may be left open by the RSS device 114 for a predetermined time period, or until the link is closed by the second mobile phone 110, so that any subsequent request from the second mobile phone 110 for converting some text into synthetic speech can be fulfilled immediately by the RSS device 114.

To summarize, the present disclosure provides a system using a realistic speech synthesis (RSS) device with one or more mobile devices that are in communication with one or more stored data repositories, which adds realism to a synthetic speech. The system comprises a first mobile device, a second mobile device, and the RSS device. The first mobile device, with a processor and a memory, associated with the first user, sending a text to a second mobile device; the second mobile device, with a processor and a memory, associated with the second user, in communication with the first mobile device and the stored data repository, wherein the second mobile device receives the text from the first mobile device, wherein the text is embedded with at least one emoticon indicating a first prosody information and a predefined sound stored in the stored data repository; and the realistic speech synthesis device in communication with the second mobile device, configured to convert the text to synthetic speech, wherein the realistic speech synthesis device is configured to: receive the text from the second mobile device; identify the first user based on a comparison between metadata associated with the text and user profiles stored in the stored data repository; retrieve a speech font from a speech data corpus associated with the first user stored in the stored data repository, wherein the speech font includes a second prosody information and a predefined accent of the first user; convert the text into synthetic speech based on the retrieved speech font, wherein the speech font is modulated based on the at least one emoticon; and send the synthetic speech to the second mobile device via said network. Additionally, the present disclosure provides that the stored data repository is on a user device (e.g., the first mobile device and the second mobile device) and/or a server via the network.

Other embodiments of the present invention will be apparent to those skilled in the art after considering this disclosure or practicing the disclosed invention. The specification and examples above are exemplary only, with the true scope of the present invention being determined by the following claims.

I claim the following invention:

1. A system using a realistic speech synthesis (RSS) device with one or more mobile devices that are in communication with one or more stored data repositories, that adds realism to synthetic speech, comprising:

a first mobile device, with a processor and a memory, associated with the first user, sending a text to a second mobile device;

a second mobile device, with a processor and a memory, associated with the second user, in communication with said first mobile device and a stored data repository, wherein said second mobile device receives said text from said first mobile device; and a realistic speech synthesis device in communication with said second mobile device, configured to convert said text to said synthetic speech, wherein said realistic speech synthesis device is configured to:

receive said text from said second mobile device;

identify the first user based on a comparison between metadata associated with said text and user profiles stored in said stored data repository;

retrieve a speech font from a speech data corpus associated with the first user stored in said stored data repository, wherein said speech font includes a second prosody information and a predefined accent of the first user;

convert said text into said synthetic speech based on said retrieved speech font, wherein said speech font is modulated based on said at least one emoticon; and send said synthetic speech to said second mobile device;

wherein said realistic speech synthesis device is allowed to access said speech font based on a valid authorization key received from said second mobile device, wherein said speech font is embedded with an audio watermark.

2. The claim according to claim 1, wherein said stored data repository is on said first mobile device, said second mobile device, and/or a server via a network.

3. The claim according to claim 1, wherein said text is embedded with at least one emoticon indicating a first prosody information and a predefined sound stored in said stored data repository.

4. The claim according to claim 1, wherein said text is pre-processed to expand one or more abbreviations in said text based on a list of abbreviations stored in said stored data repository.

5. A method to manufacture a system using a realistic speech synthesis (RSS) device with one or more mobile devices that are in communication with one or more stored data repositories, that adds realism to a synthetic speech, comprising:

providing a first mobile device, with a processor and a memory, associated with the first user, sending a text to a second mobile device;

providing a second mobile device, with a processor and a memory, associated with the second user, in communication with said first mobile device and said stored data repository, wherein said second mobile device receives said text from said first mobile device; and providing a realistic speech synthesis device in communication with said second mobile device, configured to convert said text to said synthetic speech, wherein said realistic speech synthesis device is configured to:

receive said text from said second mobile device;

identify the first user based on a comparison between metadata associated with said text and user profiles stored in said stored data repository;

retrieve a speech font from a speech data corpus associated with the first user stored in said stored data repository, wherein said speech font includes a second prosody information and a predefined accent of said first user;

convert said text into said synthetic speech based on said retrieved speech font, wherein said speech font is modulated based on said at least one emoticon; and send said synthetic speech to said second mobile device, wherein said realistic speech synthesis device is allowed to access said speech font based on a valid authorization key received from said second mobile device, wherein said speech font is embedded with an audio watermark.

6. The claim according to claim 5, wherein stored data repository is on said first mobile device, said second mobile device, and/or a server via a network.

7. The claim according to claim 5, wherein said text is embedded with at least one emoticon indicating a first prosody information and a predefined sound stored in said stored data repository.

8. The claim according to claim 5, wherein said text is pre-processed to expand one or more abbreviations in said text based on a list of abbreviations stored in said stored data repository.

9. A method to use a system using a realistic speech synthesis (RSS) device with one or more mobile devices that are in communication with one or more stored data repositories, that adds realism to a synthetic speech, comprising:

providing a first mobile device, with a processor and a memory, associated with the first user, sending a text to a second mobile device;

providing a second mobile device, with a processor and a memory, associated with the second user, in communication with said first mobile device and said stored data repository, wherein said second mobile device receives said text from said first mobile device; and using a realistic speech synthesis device in communication with said second mobile device, configured to convert said text to said synthetic speech, wherein said realistic speech synthesis device is configured to:

receive said text from said second mobile device;

identify the first user based on a comparison between metadata associated with said text and user profiles stored in said stored data repository;

retrieve a speech font from a speech data corpus associated with the first user stored in said stored data repository, wherein said speech font includes a second prosody information and a predefined accent of said first user;

convert said text into said synthetic speech based on said retrieved speech font, wherein said speech font is modulated based on said at least one emoticon; and send said synthetic speech to said second mobile device, wherein said speech font is being accessed based on a valid authorization key received from said mobile device, wherein said speech font is embedded with an audio watermark.

10. The claim according to claim 9, wherein stored data repository is on said mobile device and/or a server via a network.

11. The claim according to claim 9, wherein said text is embedded with at least one emoticon indicating a first prosody information and a predefined sound stored in said stored data repository.

12. The claim according to claim 9, wherein said text is pre-processed to expand one or more abbreviations in said text based on a list of abbreviations stored in said stored data repository.

13. A non-transitory program storage device readable by a computing device that tangibly embodies a program of instructions executable by said computing device to perform a method to implement a system using a realistic speech synthesis (RSS) device with one or more mobile devices that are in communication with one or more stored data repositories, that adds realism to a synthetic speech, comprising:

providing a first mobile device, with a processor and a memory, associated with the first user, sending a text to a second mobile device;

providing a second mobile device, with a processor and a memory, associated with the second user, in communication with said first mobile device and said stored data repository, wherein said second mobile device receives said text from said first mobile device; and using a realistic speech synthesis device in communication with said second mobile device, configured to convert said text to said synthetic speech, wherein said realistic speech synthesis device is configured to:

receive said text from said second mobile device;

identify the first user based on a comparison between metadata associated with said text and user profiles stored in said stored data repository;

retrieve a speech font from a speech data corpus associated with the first user stored in said stored data repository, wherein said speech font includes a second prosody information and a predefined accent of said first user;

convert said text into said synthetic speech based on said retrieved speech font, wherein said speech font is modulated based on said at least one emoticon; and send said synthetic speech to said second mobile device;

wherein said speech font is being accessed based on a valid authorization key received from said mobile device, wherein said speech font is embedded with an audio watermark.

14. The claim according to claim 13, wherein stored data repository is on said mobile device and/or a server via a network.

15. The claim according to claim 13, wherein said text is embedded with at least one emoticon indicating a first prosody information and a predefined sound stored in said stored data repository.

16. The claim according to claim 13, wherein said text is pre-processed to expand one or more abbreviations in said text based on a list of abbreviations stored in said stored data repository.

* * * * *